United States Patent [19]

Hillery

[11] 4,203,165

[45] May 13, 1980

[54] ACOUSTIC FILTER

[75] Inventor: Herbert V. Hillery, Austin, Tex.

[73] Assignee: The United States of America as represented by the Secretary of the Navy, Washington, D.C.

[21] Appl. No.: 618,160

[22] Filed: Oct. 24, 1956

[51] Int. Cl.[2] ..... H04R 1/44

[52] U.S. Cl. ..... 367/135; 367/149

[58] Field of Search ..... 181/35, 36, 0.55, 33; 340/8, 12, 13; 310/2

[56] References Cited

U.S. PATENT DOCUMENTS

| | | | |
|---|---|---|---|
| 2,661,430 | 12/1953 | Hardway, Jr. | 340/13 X |
| 2,769,929 | 11/1956 | Hardway, Jr. | 340/13 |
| 2,782,394 | 2/1957 | Hardway, Jr. | 340/13 |
| 2,824,292 | 2/1958 | Christoph | 340/13 |

*Primary Examiner*—Theodore M. Blum

*Attorney, Agent, or Firm*—R. S. Sciascia; A. L. Branning

EXEMPLARY CLAIM

1. A hydroacoustic filter and detecting device of the character described comprising an electrolytic detector cell having an acoustical resistance and an inertance in series therewith and an asymmetrical acoustical filter network, said filter network including means providing a pair of input acoustical capacitances with one each thereof disposed in each of the two sides of the filter to be subjected to a signal input, means including straight tube for providing acoustical resistance and inertance in output shunting relation to said input capacitances, acoustical capacitance means and a straight tube acoustical resistance-inertance means connected in series in one side of said filter and following said shunting resistance and inertance, an acoustical capacitance means in the other side of the filter and connected in an acoustical shunting relation between said input shunting straight tube connection and the output termination of said series connected capacitance and resistance-inertance to provide one output terminal of said filter, said electrolytic detector cell being connected in shunting relation to said last named acoustical capacitance means with one output termination common to said first mentioned filter output termination and a second output termination connected in impedance dividing relation between the acoustical capacitance provided by said detector cell and the series inertance and acoustical resistance thereof.

6 Claims, 4 Drawing Figures

ACOUSTIC FILTER

This invention relates to an acoustic filter for use in an underwater acoustic listening device.

More particularly the instant filter is one providing improved filter circuitry over that disclosed in the copending applications of R. N. Lane et al, Ser. No. 579,700, filed Apr. 20, 1956 and O. H. Hill et al, Ser. No. 611,395, filed Sept. 21, 1956. The prior filters described in the foregoing copending applications present certain limiting properties which render these devices unsuitable for certain applications in that the filter responses are a function of the static head. The prior type filters contain more parts and in general are physically larger than the improved filter of the instant invention.

The instant acoustic filter uses an improved hydroacoustic circuit configuration hereinafter to be described, and the incorporation of this circuit with a detector of the general character shown and described in the copending application of Walter P. Christoph Ser. No. 451,317, filed Aug. 20, 1954, facilitates the manufacture of a very compact detector and filter assembly, the response of which is essentially independent of the static head applied to the filter input. Moreover, it advantageously provides for a filter assembly utilizing straight tubes of reasonable length to provide the acoustical inertance and thereby provide for economical use of space in the listening device. This factor is frequently an important consideration in detector mechanisms for underwater ordnance use.

In the prior type filter systems certain operational drawbacks have been encountered with the use of air cavities as acoustical capacitance elements in acoustic filters, and particularly since the use thereof required that the pressure inside the filter remain substantially constant regardless of the static head applied to the input of the filters. If the pressure inside the air cavities, which is the same as the pressure inside the filters, changes, the acoustical capacitance of the cavities will change and the response characteristics of the filter will be altered. The use of air cavities gives the undeniable advantage of allowing a filter to be given a final tuning after assembly, but every effort must be made to keep the pressure inside the filters substantially constant.

Attempts have been made to accomplish this desired relationship of keeping the internal pressures essentially constant, by using very soft detector diaphragms with large take-up characteristics. This problem has been complicated somewhat by the fact that the material polymonochlorotrifluoroethylene and known in the trade and hereinafter referred to as Kel-F, a product of the W. Kellogg Co. of Jersey City, New Jersey, which is the most desirable material presently available for the detector casing, is inherently quite stiff. Moreover a minimum of thickness of 0.005" is required for use of Kel-F as a diaphragm if air which will tend to poison the electrolyte solution is to be excluded from the detector cell. This means of controlling internal pressure of the filters has not proved to be altogether successful.

One apparent solution to this problem resides in the use of a Kel-F bellows having the required softness and take-up. Another possibile solution to the problem lies in the use of detector diaphragms of a much larger area, thus securing the required softness and take-up to provide a very large acoustical capacitance. However, both of these expedients, even if made to work successfully, are bought dearly for in most applications the space required for the detector will be greater and consequently the filter construction itself will have to be larger and will therefor require more material for its construction.

The instant filter while primarily directed to overcoming the problem of internal pressure in acoustic filters, in addition allows for filters that are more compact and more readily constructed.

It is a feature of this invention to provide a filter which is of less physical size than filters heretofore or now in general use and in which the response is independent of the static head to which the filter is subjected.

One object of the invention resides in the provision of an improved filter for narrow low frequency pass bands, the efficiency of which is greater than filters heretofore available for underwater acoustic detector mechanisms.

It is a further object to provide a filter in which the adjacent band attenuation of the filter is greater than previous designs and in which the input arm comprises acoustical capacitance, inertance and acoustical resistance elements which can be made of high enough "Q" to reflect an amplified pressure signal into the balance of the system following the filter circuit, thereby substantially overcoming insertion loss effects inherent in prior filter systems.

It is a further object of the invention to provide an acoustic filter of small physical size which is easier to produce than filters heretofore available.

Other objects and many of the attendant advantages of this invention will be readily appreciated as the same becomes better understood by reference to the following detailed description when considered in connection with the accompanying drawings wherein.

The prior art types of filters of the character described in the aforementioned copending applications of Lane et al and Hill et al, which are examples of the only known types of devices of the instant character, both incorporate an electrolytic detector of the general type described in the copending Christoph application as a portion of the filter circuitry. The instant invention is also directed to a circuit utilizing such a detector. However, since the details of the detector form no additional part of this invention the description of the detector is limited to a brief correlation of the analog circuit and mechanical arrangement thereof with the structure of the instant filter.

Figure 1:
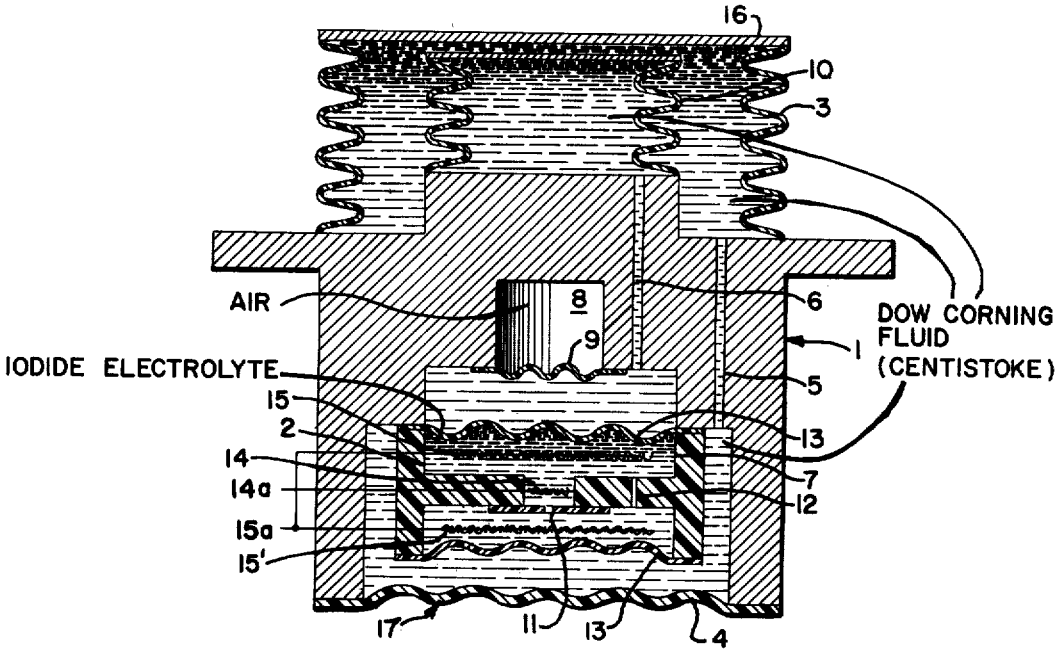
FIG. 1 is a vertical section of an acoustic filter according to the instant invention.

Referring now to FIG. 1, there is shown an embodiment of the improved acoustic filter device generally designated 1 for use with an electrolytic detector generally indicated 2 for accomplishing the desired signal filtering characteristics.

Figure 2:
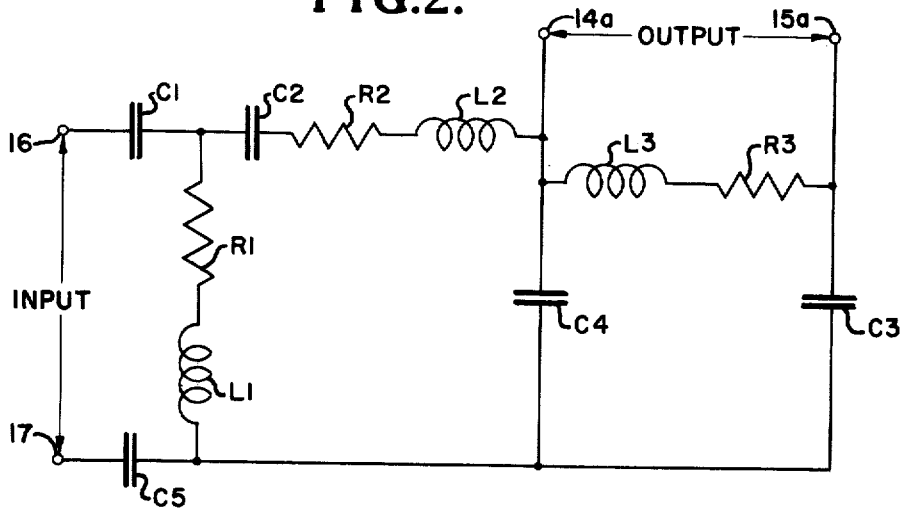
FIG. 2 is a schematic diagram of the electrical analog of the filter of FIG. 1.

The detector 2 is more fully described in the aforementioned applications of Christoph and Lane et al. A typical detector may comprise a plastic body 7 composed of a thermoplastic insulating material, which is chemically inert to an electrolyte solution, enclosing an electrolyte solution as by a pair of diaphragms 13. The pair of diaphragms 13 may advantageously be of a chemically inert plastic material such as that known in the art as Kel-F. A partition integral with the body 7 supports the cathode 14. It effectively divides the interior of the cell into a pair of chambers for detection of acoustic signals by the flow of ions through the ion starved cathodes. A suitable oxidation reduction solution such as a water base oxidation reduction iodide electrolyte is disposed in the chambers. This provides an electrical current flow in the output circuit. Disposed in the central portion of the partition is a noble metal cathode 14 having an orifice therethrough and providing flow communication between the chambers of the anode electrode 15 and the anode electrode 15'. The electrodes 15 and 15' are connected by an external lead to an external circuit and the cathode electrode 14 is connected to the same external circuit. The electrolyte fluid in the detector may be an oxidation reduction iodide electrolyte of a character in which the iodine molecules are collected in the anode cathode circuit thereof to provide a direct current flow irrespective of the direction of electrolytic flow. The corresponding electrical analog circuit is shown in FIG. 2 with the corresponding electrical circuit components represented by the prefix C for capacitances, R for resistances and L for inductances.

In the instant filter circuit all but a very small portion of the static head applied to the filter system is dropped across the input bellows 3, which may be composed preferably of a thermal plastic which is chemically inert to the electrolyte, represented schematically as capacitance C1 while the remainder is applied to the backing diaphragm 4 represented by C5 and consequently to the inside of the filter.

The remainder can be made small enough to the negligible by proper choice of a very soft material for the diaphragm 4, C5. The problem of providing a soft diaphragm for this purpose may be readily solved since the soft diaphragm need not be of Kel-F material. All that is required in the instant case is a flexible diaphragm made of a thermoplastic material which will withstand the chemical action of 1 centistoke kinematic viscosity Dow-Corning silicone fluid which is one preferred fluid for filling the cavities formed between the body of the filter, and diaphragm 4, bellows 3 and bellows 10 as shown in FIG. 1.

The input shunt leg of the filter is provided by the tube or passage 5 which presets on acoustical resistance and inertance, the electrical equivalent representation of which is indicated as inductance L1 and resistance R1.

By a proper choice of values for C1 and R1, L1, most of the acoustic pressure signal in a given frequency band can be made to appear across R1, L1, and consequently across the acoustical resistance and inertance represented in FIG. 2 by the analogous electrical quantities the rest of the filter. The series acoustical capacitance analogous to the capacitance C2 is provided by the bellows 10.

The aforementioned advantages of this filter circuit include not only the fact that with it the acoustical capacitance of the air cavity 8, which is represented in the analogous electrical circuit as C4, can be made essentially independent of the static head but also the fact that the size of the detector 2 can be greatly reduced because the diaphragms thereof need not be designed for large volume take-up. The size of the detectors used on present prior art filter models now in general use is much larger than needed to provide the space required for the anode 15 anode 15' and the cathode 14 of the detector.

The instant filter however provides the additional advantage that the circuit requires only straight inertance tubes 5 and 6 of reasonable length. In the same manner that the electrical equivalent of passage 5 is indicated by $L_1$ and $R_1$ in FIG. 2, the electrical equivalent of passage 6 is shown by $L_2$ and $R_2$ in FIG. 2. The electrolytic detector cell body is generally indicated at 7; the cell 2 may be considered to correspond to the equivalent electrical analog circuit elements $L_3$, $R_3$ and $C_3$, wherein the cathode orifice 11 together with the by-pass passage 12 appears as $R_3$, $L_3$, and the compliant detector diaphragms 13 correspond to the shunt capacitance $C_3$.

The electrical output from the detector appears across the output terminals **14*a* and 15*a*. The filter input across 16 and 17 corresponds to the input plate 16 and diaphragm 4 at 17. The acoustical capacitance of air cavity 8 which is closed by diaphragm 9 is represented in the electrical analog of FIG. 2 by capacitance C4**.

Figure 3:
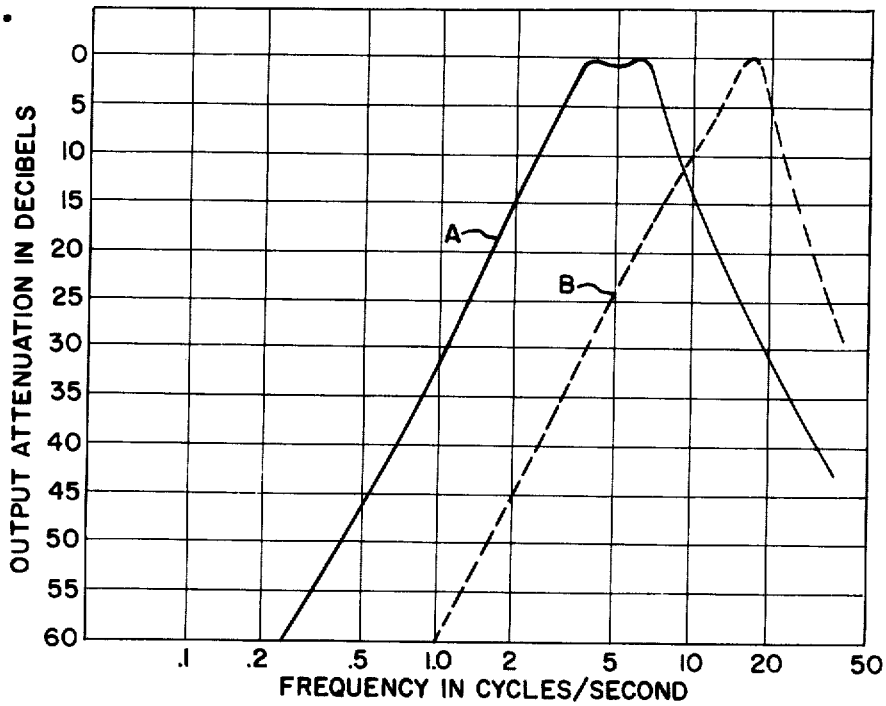
FIG. 3 is a graphical illustration showing two curves of the frequency attenuation characteristics of two different constructions of the filter of FIG. 1.
Figure 4:
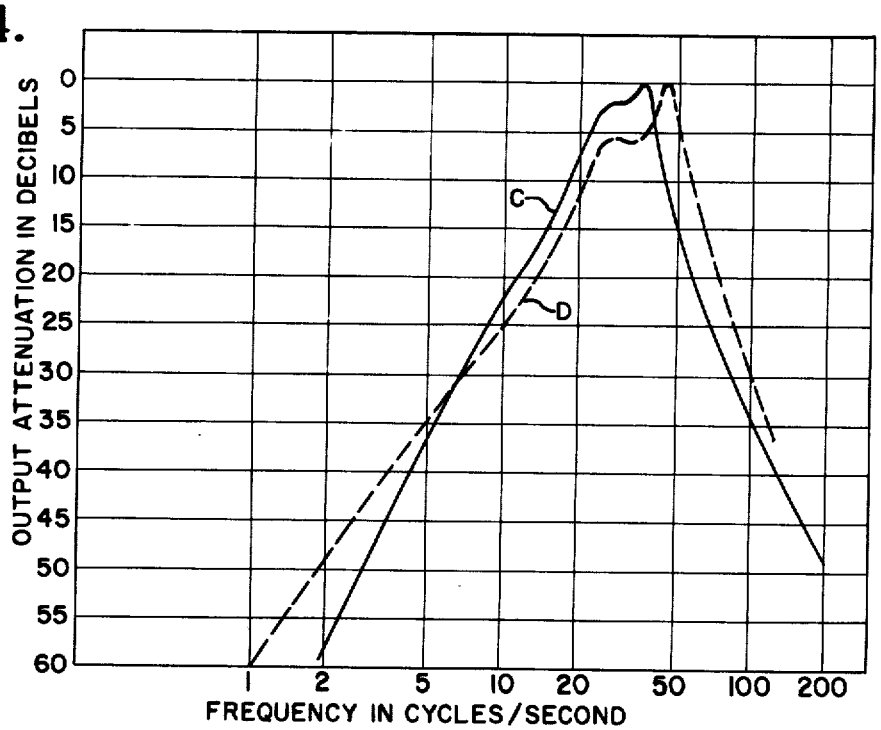
FIG. 4 is a graphical illustration of the character of FIG. 3 for a second pair of filters of differing pass band characteristics.

Referring now to FIGS. 3 and 4 the response characteristics of four different sets of circuit parameter values for different pass bands of interest are shown by the several curves, obtained using an analogous electrical circuit.

The high end of the pass band of these response curves has purposely been provided to compensate for the high frequency fall off of the response of electrolytic detector cells used in the acoustic filters.

The curve A of FIG. 3, is a typical characteristic curve that may be expected in response to an input signal of 3 to 7 cycles per second with a 1.2 db insertion gain when the acoustical capacitance, resistance and inertance as represented to the analogous electrical capacitance, resistance and inductance to FIG. 2 are:

| | |
|---|---|
| $C1 = 5.10^{-6}$ | $\frac{cm^3}{dynes/cm^2}$ |
| $L1 = 350$ | $\frac{dynes/cm^2}{cm^3/sec^2}$ |
| $R1 = 6000$ | $\frac{dynes/cm^2}{cm^3/sec}$ |
| $C2 = 7.10^{-6}$ | $\frac{cm^3}{dynes/cm^2}$ |
| $L2 = 400$ | $\frac{dynes/cm^2}{cm^3/sec^2}$ |
| $R2 = 6500$ | $\frac{dynes/cm^2}{cm^3/sec}$ |
| $R3 = 2000$ | $\frac{dynes/cm^2}{cm^3/sec}$ |
| $L3 = 40$ | $\frac{dynes/cm^2}{cm^3/sec^2}$ |
| C3 = Very Large; | value may be neglected |
| $C4 = 5.10^{-6}$ | $\frac{cm^3}{dynes/cm^2}$ |
| C5 = Very Large; | value may be neglected |

The curve B of FIG. 3 is a typical characteristic curve that may be expected in response to a 10 to 20 cycle per second signal and providing a 2.8 db insertion loss when the acoustical capacitance, resistance and inertance of the components as represented in the analogous electrical circuit of FIG. 2 are:

| | |
|---|---|
| $C1 = .8 \cdot 10^{-6}$ | $\frac{cm^3}{dynes/cm^2}$ |
| $L1 = 300$ | $\frac{dynes/cm^2}{cm^3/sec^2}$ |
| $R1 = 7000$ | $\frac{dynes/cm^2}{cm^3/sec}$ |
| $C2 = 1.0 \cdot 10$ | $\frac{cm^3}{dynes/cm^2}$ |
| $L2 = 300$ | $\frac{dynes/cm^2}{cm^3/sec^2}$ |
| $R2 = 7000$ | $\frac{dynes/cm^2}{cm^3/sec}$ |
| $L3 = 45$ | $\frac{dynes/cm^2}{cm^3/sec^2}$ |
| $R3 = 3000$ | $\frac{dynes/cm^2}{cm^3/sec}$ |
| C3 = Very Large: | value may be neglected |
| $C4 = 2.2 \cdot 10^{-6}$ | $\frac{cm^3}{dynes/cm^2}$ |
| C5 = Very Large; | value may be neglected |

The curve C of FIG. 4 for a 20 to 40 cps filter provides characteristics similar to that shown and with an insertion gain of 4.7 db when the acoustical capacitance, resistance and inertance as represented by the analogous electrical capacitance, resistance and inertance of FIG. 2 are:

| | |
|---|---|
| $C1 = .6 \cdot 10^{-6}$ | $\frac{cm^3}{dynes/cm^2}$ |
| $L1 = 120$ | $\frac{dynes/cm^2}{cm^3/sec^2}$ |
| $R1 = 3000$ | $\frac{dynes/cm^2}{cm^3/sec}$ |
| $C2 = 1.7 \cdot 10^{-6}$ | $\frac{cm^3}{dynes/cm^2}$ |
| $L2 = 100$ | $\frac{dynes/cm^2}{cm^3/sec^2}$ |
| $R2 = 3000$ | $\frac{dynes/cm^2}{cm^3/sec}$ |
| $C4 = .9 \cdot 10^{-6}$ | $\frac{cm^3}{dynes/cm^2}$ |
| $L3 = 40$ | $\frac{dynes/cm^2}{cm^3/sec^2}$ |
| $R3 = 3000$ | $\frac{dynes/cm^2}{cm^3/sec}$ |
| C3 = Very Large; | value may be neglected |
| C5 = Very Large; | value may be neglected |

Similarly the response curve D of FIG. 4 may be expected from a 15 to 60 cps filter and with an insertion gain of 6.4 db when the acoustical capacitance, resistance and inertance as represented by the analogous electrical resistance, capacitance and inductance of FIG. 2 are:

| | |
|---|---|
| $C1 = .6 \cdot 10^{-6}$ | $\frac{cm^3}{dynes/cm^2}$ |
| $L1 = 200$ | $\frac{dynes/cm^2}{cm^3/sec^2}$ |
| $R1 = 10{,}000$ | $\frac{dynes/cm^2}{cm^3/sec}$ |
| $C2 = 3 \cdot 10^{-6}$ | $\frac{cm^3}{dynes/cm^2}$ |

-continued

| | |
|---|---|
| $L2 = 45$ | $\frac{dynes/cm^2}{cm^3/sec^2}$ |
| $R2 = 2000$ | $\frac{dynes/cm^2}{cm^3/sec}$ |
| C3 = Very Large; | value may be neglected |
| $L3 = 29$ | $\frac{dynes/cm^2}{cm^3/sec^2}$ |
| $R3 = 2500$ | $\frac{dynes/cm^2}{cm^3/sec}$ |
| $C4 = .8 \cdot 10^{-6}$ | $\frac{cm^3}{dynes/cm^2}$ |
| C5 = Very Large; | value may be neglected |

A tabulation of the dimensions of the tubes required for the various filters corresponding to the parameters given in the response curves is as follows:

| | | Length in Inches | Diameter in Inches |
|---|---|---|---|
| 3 to 7 cps filter | L1,R1 | 1.69 | .052 |
| | L2,R2 | 2.07 | .053 |
| 10 to 20 cps filter | L1,R1 | 1.83 | .056 |
| | L2,R2 | 1.83 | .056 |
| 20 to 40 cps filter | L1,R1 | 1.17 | .068 |
| | L2,R2 | .689 | .059 |
| 15 to 60 cps filter | L1,R1 | .504 | .036 |
| | L2,R2 | .117 | .040 |

Obviously many modification and variations of the present invention are possible in the light of the above teachings. It is therefore to be understood that within the scope of the appended claims the invention may be practiced otherwise than as specifically described.

What is claimed as new and desired to be secured by Letters Patent of the United States is:

1. A hydroacoustic filter and detecting device of the character described comprising an electrolytic detector cell having an acoustical resistance and an inertance in series therewith and an asymmetrical acoustical filter network, said filter network including means providing a pair of input acoustical capacitances with one each thereof disposed in each of the two sides of the filter to be subjected to a signal input, means including straight tube for providing acoustical resistance and inertance in output shunting relation to said input capacitances, acoustical capacitance means and a straight tube acoustical resistance inertance means connected in series in one side of said filter and following said shunting resistance and inertance, a acoustical capacitance means in the other side of the filter and connected in an acoustical shunting relation between said input shunting straight tube connection and the output termination of said series connected capacitance and resistance-inertance to provide one output terminal of said filter, said electrolytic detector cell being connected in shunting relation to said last named acoustical capacitance means with one output termination common to said first mentioned filter output termination and a second output termination connected in impedance dividing relation between the acoustical capacitance provided by said detector cell and the series inertance and acoustical resistance thereof.

2. The structure according to claim 1 further including electrical terminal means disposed in circit with said detector for providing detector electrical output signals in the pass band of the filter of said device.

3. An acoustical filter comprising; a body, first compliant means for receiving an acoustical input signal secured to said body and together therewith defining a first chamber, a liquid substantially filling the chamber, second compliant means for receiving the input signal, said second compliant means being secured to said body and together therewith defining a second chamber, a liquid substantially filling the second chamber, third compliant means affixed to said body and defining a third chamber within said first chamber, an acoustical electric transducer having a pair of compliant input means and disposed within said second chamber, said compliant input means being acoustically connected to the liquid in said second chamber, an air cavity formed in said body, a diaphragm disposed over said air cavity and in contact with the liquid in said second chamber for acoustical connection with said transducer and said second compliant means, a first passageway through said body providing an acoustical resistance inertance coupling between said first chamber and said second chamber, a second passageway through said body providing an acoustical resistance inertance coupling between said second chamber and said third chamber.

4. The filter of claim 3 wherein said second compliant means provides an acoustical capacitance larger than that of said first compliant means.

5. The filter of claim 3 wherein said second compliant means is softer than said first compliant means whereby most of the ambient static head applied to the filter is dropped across said first compliant means.

6. An acoustic filter for use in combination with an electrolytic detector cell and comprising; a body portion, first compliant means connected to said body portion and together therewith defining a fluid chamber, said compliant means being acoustically coupled to an acoustical signal transmitting medium, a fluid substantially filling the chamber, said compliant means providing an acoustical input capacitance for receiving acoustic signal from the medium, second compliant means secured to said body portion and together therewith defining a second chamber, said second compliant means having a greater acoustic capacitance than said first compliant means, a passage through said body portion providing an acoustical resistance and inertance shunt across the acoustical input capacitance provided by said first compliant means, third compliant means disposed within the second chamber and providing an acoustical capacitance in series with the acoustical capacitance of said first compliant means, said third compliant means providing also an acoustical capacitance shunt between the acoustical capacitances of said first compliant means and said second compliant means, the acoustical capacitance of said second compliant means being coupled to the detector cell, and a second passageway within said body providing an acoustical resistance inertance between the acoustical capacitance of said third compliant means and the input of said detector cell.

* * * * *